US010390600B2

(12) United States Patent
Kang

(10) Patent No.: US 10,390,600 B2
(45) Date of Patent: Aug. 27, 2019

(54) AUTOMATIC HAIR POWDER DISPENSER

(71) Applicant: Wan Jun Kang, Uiwang-si (KR)

(72) Inventor: Wan Jun Kang, Uiwang-si (KR)

( * ) Notice: Subject to any disclaimer, the term of this patent is extended or adjusted under 35 U.S.C. 154(b) by 5 days.

(21) Appl. No.: 15/552,152

(22) PCT Filed: Feb. 10, 2017

(86) PCT No.: PCT/KR2017/001460
§ 371 (c)(1),
(2) Date: Aug. 18, 2017

(87) PCT Pub. No.: WO2018/135691
PCT Pub. Date: Jul. 26, 2018

(65) Prior Publication Data

US 2018/0325236 A1 Nov. 15, 2018

(30) Foreign Application Priority Data

Jan. 20, 2017 (KR) ..... 10 2017 001 0073

(51) Int. Cl.
*A45D 33/02* (2006.01)
*A45D 19/00* (2006.01)
*A45D 33/00* (2006.01)

(52) U.S. Cl.
CPC ..... *A45D 33/02* (2013.01); *A45D 19/00* (2013.01); *A45D 33/00* (2013.01); *A45D 2019/0033* (2013.01); *A45D 2200/054* (2013.01)

(58) Field of Classification Search
CPC ..... A45D 33/00; A45D 33/08; A45D 24/26; A45D 33/26; A45D 33/02; A45D 19/00; B65D 47/00; B65D 83/06
USPC ..... 222/195, 258, 325, 333, 626
See application file for complete search history.

(56) References Cited

U.S. PATENT DOCUMENTS

2017/0143095 A1* 5/2017 Kang ..... A45D 33/02

FOREIGN PATENT DOCUMENTS

| | | | |
|---|---|---|---|
| JP | H10-216612 | A | 8/1998 |
| JP | H10-236064 | A | 9/1998 |
| JP | 3126860 | U | 11/2006 |
| KR | 200467893 | Y1 | 7/2013 |
| KR | 101463718 | B1 | 11/2014 |
| KR | 20160142033 | A | 12/2016 |

OTHER PUBLICATIONS

KR101463718 with Machine Translation.*

* cited by examiner

*Primary Examiner* — Vishal Pancholi
(74) *Attorney, Agent, or Firm* — Young Basile Hanlon & MacFarlane, P.C.

(57) ABSTRACT

An automatic hair powder dispenser includes a housing, a cartridge that is installed in the housing and accommodates hair powder, a blower fan unit that is installed in the housing so as to be in communication with the cartridge, and a battery that is installed in the housing and supplies electric power to the blower fan unit. Two or more flow tubes through which air supplied from the blower fan unit flows in different directions are provided in the cartridge, thereby efficiently dispersing the hair powder in the cartridge and easily and uniformly discharging the hair powder.

20 Claims, 6 Drawing Sheets

AUTOMATIC HAIR POWDER DISPENSER

TECHNICAL FIELD

The present disclosure relates to a hair powder dispenser, and more particularly, to an automatic hair powder dispenser capable of allowing a user to conveniently dispense and apply hair powder and preventing the hair powder from being scattered everywhere, thereby minimizing a waste of the hair powder.

BACKGROUND

Hair loss was often experienced by middle-aged or older people in the past, but many young people in their 20s and 30s with hair loss are markedly increased at present due to various types of stress, environmental pollution, eating instant food, and the like.

Therefore, many types of anti-hair loss agents or hair growth agents have been developed at home and abroad based on western and oriental medicine, but the products, which have been released so far, have insignificant effects or cause severe physical adverse effects in spite of some effects.

Recently, a hair ointment, which is called hair powder, that is, black powder, has been developed and used to cover a site where the scalp is exposed because of thin hair, using techniques similar to makeup techniques.

The hair powder is stored in the form of powder in a storage container, discharged to the outside through a plurality of holes formed at an upper side of the storage container, and is thus applied onto the head. Because a user holds and shakes the storage container above the head, there are problems in that it is difficult to accurately sprinkle the hair powder onto a particular site of the head, and the hair powder is wasted because the hair powder is scattered everywhere.

SUMMARY

To solve the problems, the inventors of the present disclosure have proposed an automatic hair powder dispenser disclosed in Korean Patent Nos. 10-1463718 and 10-1526174, which is capable of allowing a user to conveniently apply the hair powder and minimizing scattering of the hair powder everywhere.

However, the automatic hair powder dispenser has a problem in that the automatic hair powder dispenser cannot uniformly discharge the hair powder when dispersing the hair powder in a cartridge and dispensing the hair powder.

The present disclosure has been made in an effort to solve the problems in the related art, and an object of the present disclosure is to provide an automatic hair powder dispenser capable of efficiently dispersing hair powder in a cartridge and easily and uniformly discharging the hair powder.

In addition, another object of the present disclosure is to provide an automatic hair powder dispenser capable of preventing hair powder from being unnecessarily discharged when a user does not want to discharge the hair powder.

To achieve the aforementioned objects, an automatic hair powder dispenser according to the present disclosure includes: a housing; a cartridge which is installed in the housing and accommodates hair powder; a blower fan unit which is installed in the housing so as to be in communication with the cartridge; and a battery which is installed in the housing and supplies electric power to the blower fan unit, in which two or more flow tubes through which air supplied from the blower fan unit flows in different directions are provided in the cartridge.

The two or more flow tubes may include a first flow tube which protrudes upward from a bottom surface in the cartridge, and a second flow tube which is formed to be spaced apart from the first flow tube.

A bent portion, which changes an air flow, may be formed at an upper side of the first flow tube, a flow direction of air, which is introduced into the first flow tube from the blower fan unit, may be changed to be directed toward the second flow tube by the bent portion.

In addition, the hair powder may flow upward by air discharged from the first and second flow tubes, and the hair powder may be guided to a discharge guide along an inclined surface at an upper side of the second flow tube.

In addition, the blower fan unit may include a blower fan, and two or more supply tubes which are in communication with the blower fan, and the two or more supply tubes may be in communication with the cartridge. Here, the two or more supply tubes of the blower fan unit may be in communication with the two or more flow tubes, respectively.

In addition, the two or more supply tubes of the blower fan unit may include a first supply tube and a second supply tube which are in communication with the interior of the cartridge.

In addition, the blower fan may include an upper blower and a lower blower, the upper blower may be in communication with the first supply tube, and the lower blower may be in communication with the second supply tube.

In addition, the first supply tube of the blower fan unit may be in communication with a first flow tube of the cartridge, and the second supply tube of the blower fan unit may be in communication with the second flow tube of the cartridge. Alternatively, the first supply tube of the blower fan unit may be in communication with a second flow tube of the cartridge, and the second supply tube of the blower fan unit may be in communication with the first flow tube of the cartridge.

In addition, a mount for accommodating a ball may be formed at a lower side of the discharge guide. Here, the ball may be movable in the mount in an up and down direction of the cartridge, the ball may be supported by a lower portion of the mount when the ball is positioned at a lowermost side, and the ball may block the discharge guide to prevent a flow of the hair powder when the ball is positioned at an uppermost side.

In addition, the housing may include a main body, and a front cover installed at a front side of the main body, and the front cover may have an inlet through which outside air is introduced, and a discharge port through which the hair powder in the cartridge is discharged to the outside.

In addition, a discharge guide may be installed at an upper side of the cartridge so as to be in communication with the cartridge, and the discharge guide may be in communication with the discharge port.

According to the automatic hair powder dispenser of the present disclosure which is configured as described above, the two or more flow tubes through which air flows in different directions are disposed in the cartridge, and as a result, it is possible to efficiently disperse the hair powder in the cartridge and easily and uniformly discharge the hair powder.

In addition, according to the automatic hair powder dispenser of the present disclosure, it is possible to prevent the hair powder from being unnecessarily discharged when a user does not want to discharge the hair powder.

DETAILED DESCRIPTION

Figure 1:
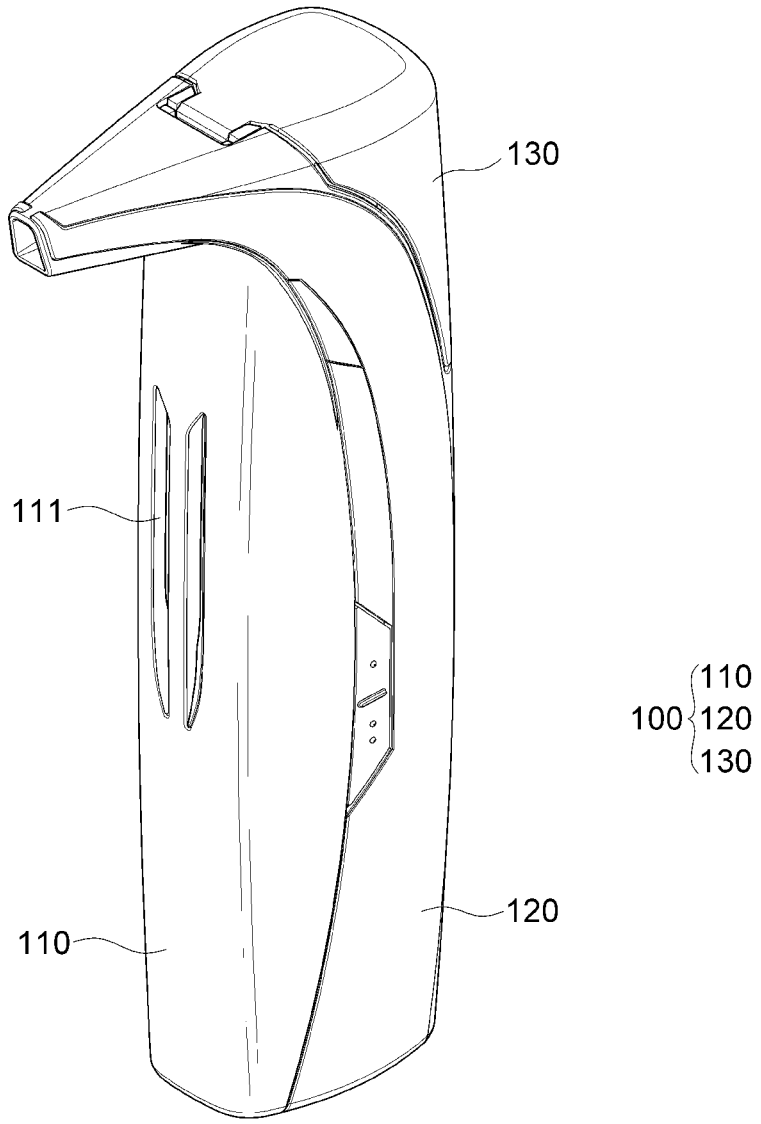
FIG. 1 is a perspective view illustrating an automatic hair powder dispenser according to the present disclosure.
Figure 2:
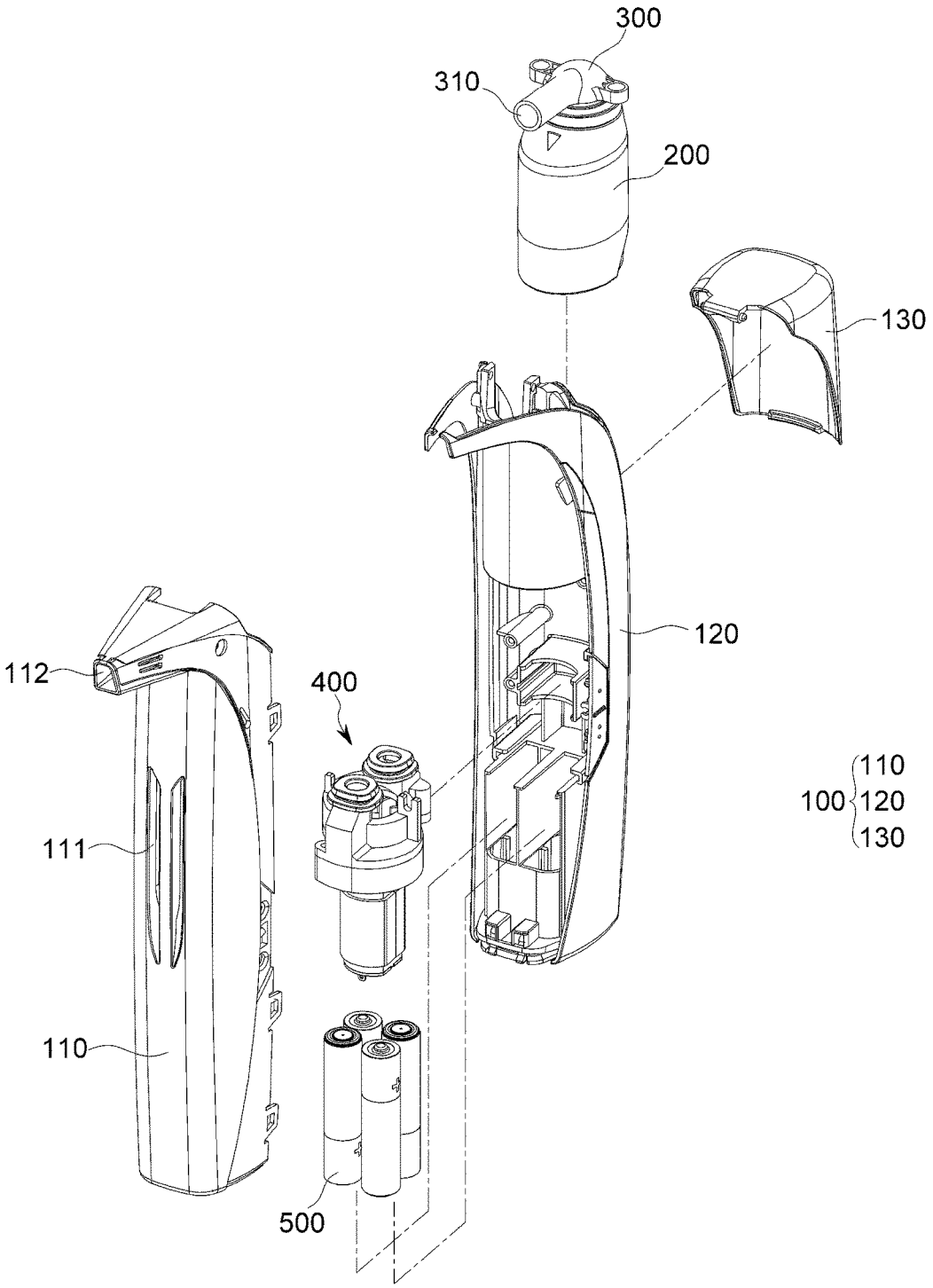
FIG. 2 is an exploded perspective view of the automatic hair powder dispenser in FIG. 1.

Hereinafter, an exemplary embodiment of an automatic hair powder dispenser according to the present disclosure will be described in detail with reference to FIGS. 1 to 7.

The automatic hair powder dispenser according to the present disclosure includes a housing 100, a cartridge 200 which is installed at an upper side of the interior of the housing 100, a blower fan unit 400 which is installed in the middle of the interior of the housing 100, and a battery 500 which is installed at a lower side of the interior of the housing 100.

The housing 100 defines an external shape of the automatic hair powder dispenser, and accommodates the cartridge 200, the blower fan unit 400, and the battery 500. The housing 100 includes a front cover 110, a main body 120 which has a front side at which the front cover 110 is installed, and an opening and closing cover 130 which is installed at an upper side of the main body 120.

The main body 120 serves as a framework of the housing 100, and provides a space in which the cartridge 200, the blower fan unit 400, and the battery 500 may be installed. An operating button 121 is provided on a rear central portion of the main body 120 (see FIG. 3). The operating button 121 serves to supply electric power from the battery 500 to the blower fan unit 400 or cut off the supply of electric power.

An inlet 111 is provided at a center of the front cover 110, and a discharge port 112 is provided at an upper end of the front cover 110. The inlet 111 is a portion through which outside air is introduced, and when the blower fan unit 400 is operated, outside air is introduced into the inlet 111 by suction force of the blower fan unit 400. The discharge port 112 is formed at the upper end of the front cover 110 so as to be directed forward, and hair powder in the cartridge 200 is discharged to the outside through the discharge port 112.

The cartridge 200 is installed at the upper side of the interior of the housing 100, an upper portion of the cartridge 200 is in communication with a discharge guide 300, and the discharge guide 300 is in communication with the discharge port 112. A lower portion of the cartridge 200 is in communication with the blower fan unit 400. Therefore, outside air introduced into the inlet 111 flows while passing through the blower fan unit 400 and flows into the cartridge 200, and the outside air introduced into the cartridge 200 flows upward together with the hair powder and is discharged to the discharge port 112 through the discharge guide 300.

The opening and closing cover 130 is detachably installed at an upper side of the main body 120, and prevents the cartridge 200 from being exposed to the outside.

The cartridge 200 has an internal space in which the hair powder is stored, and the cartridge 200 is detachably mounted at a rear upper side of the main body 120 of the housing 100. The cartridge 200 has a first flow tube 210 which protrudes upward from a bottom surface at a lower side of the interior of the cartridge 200, and a second flow tube 220 which is formed to be spaced apart from the first flow tube 210.

A bent portion 211, which changes an air flow, is formed at an upper side of the first flow tube 210. A flow direction of the air, which is introduced into the first flow tube from the blower fan unit 400, is changed to be directed toward the second flow tube 220 by the bent portion 211.

A check valve 221 is disposed at an upper end of the second flow tube 220 so that the air introduced from the blower fan unit 400 is sprinkled only in one direction, that is, only upward. The air supplied into the second flow tube 220 disperses the hair powder stacked on the bottom surface of the interior of the cartridge 200, and activates the hair powder so that the hair powder easily flows.

The blower fan unit 400 is installed in the middle of the interior of the housing 100 and introduces outside air through the inlet 111, and then the blower fan unit 400 supplies the air into the cartridge 200 to discharge the hair powder stored in the cartridge 200 to the outside through the discharge port 112.

In more detail, the blower fan unit 400 includes a motor 410, a blower fan 420 which is installed on a motor shaft of the motor 410, and first and second supply tubes 430 and 440 which are in communication with the interior of the cartridge 200. The motor 410 is operated by being supplied with electric power from the battery 500. The blower fan 420 includes an upper blower 421 and a lower blower 422. The upper blower 421 is in communication with the first supply tube 430, and the first supply tube 430 is in communication with the first flow tube 210 of the cartridge 200. The lower blower 422 is in communication with the second supply tube 440, and the second supply tube 440 is in communication with the second flow tube 220 of the cartridge 200. Of course, it is possible to implement a structure in which the first supply tube 430 is in communication with the second flow tube 220 and the second supply tube 440 is in communication with the first flow tube 210. In addition, in the exemplary embodiment in FIG. 3, the two flow tubes are provided to be supplied with air from the blower fan unit 400, but three or more flow tubes may be provided.

When electric power is supplied to the motor 410, the blower fan 420 is rotated together with the motor shaft, thereby introducing outside air from the inlet 111. The outside air, which is introduced by the blower fan 420, flows to the first supply tube 430 by the rotation of the upper blower 421, and is supplied into the cartridge 200 through the first flow tube 210 of the cartridge 200, and the outside air flows to the second supply tube 440 by the rotation of the lower blower 422, and is supplied into the cartridge 200 through the second flow tube 220 of the cartridge 200.

Figure 3:
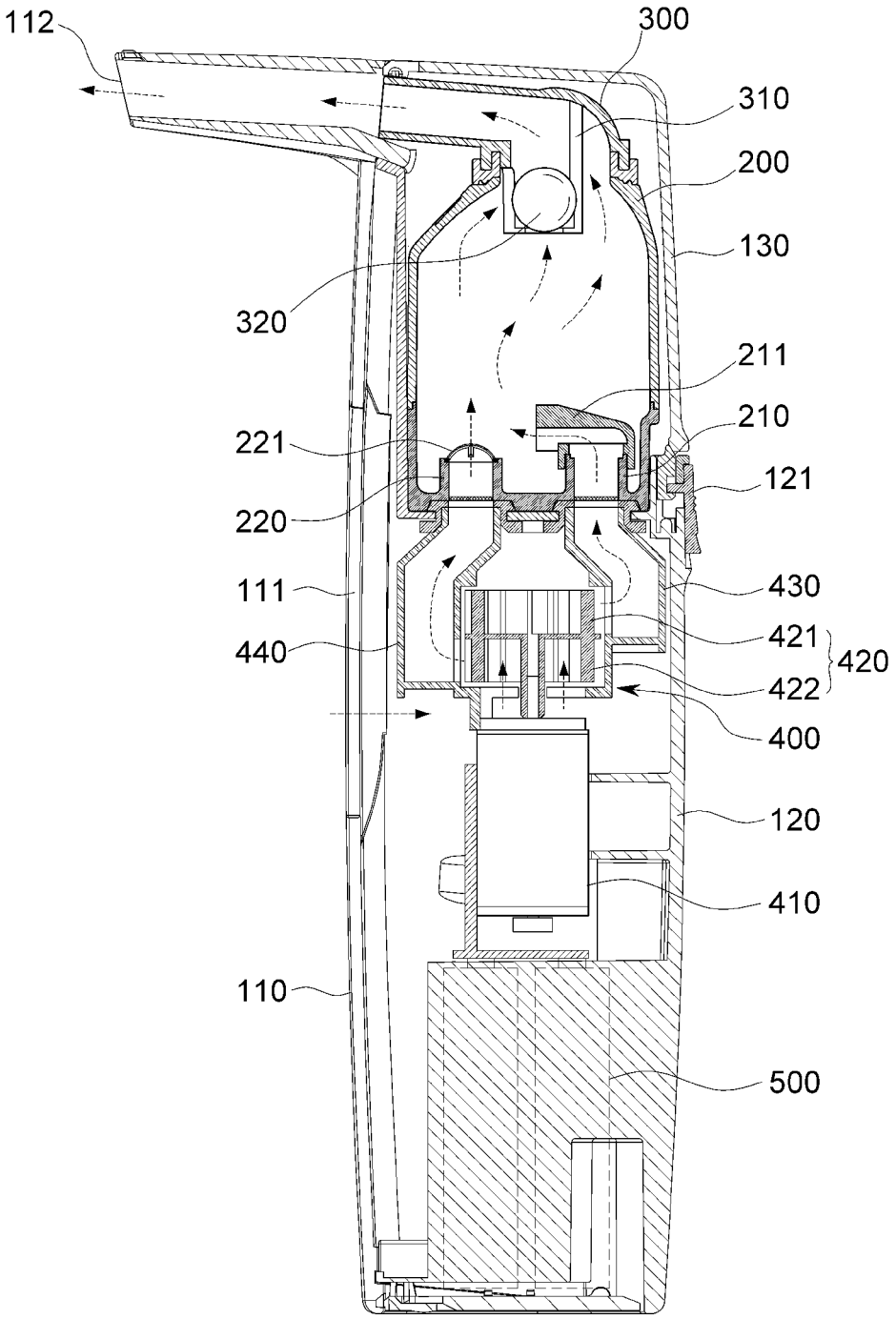
FIG. 3 is a cross-sectional view of the automatic hair powder dispenser in FIG. 1.

Hereinafter, a principle in which the hair powder in the cartridge 200 is dispersed and uniformly discharged will be described with reference to the exemplary embodiment illustrated in FIGS. 3 and 4.

The air is supplied into the cartridge 200 from the first and second supply tubes 430 and 440 of the blower fan unit 400 through the first and second flow tubes 210 and 220 formed at the lower side of the cartridge 200. Here, the first and second flow tubes 210 and 220 protrude to a predetermined height from the bottom surface of the cartridge 200. The air supplied to the second flow tube 220 disperses the hair powder stacked on the bottom surface of the interior of the cartridge 200, and activates the hair powder so that the hair powder easily flows. The activated hair powder is easily discharged by the air supplied into the first flow tube 210. That is, the air, which is introduced into the first flow tube from the first supply tube 430 of the blower fan unit 400, is discharged toward the second flow tube 220 through the bent portion 211, and the hair powder, which is activated by the air discharged from the second flow tube 220, is discharged to the outside while flowing toward the upper side of the cartridge. The hair powder, which flows toward the upper side of the cartridge, is guided to the discharge guide 300 along an inclined surface at the upper side of the second flow tube 220, and the hair powder is discharged to the outside through the discharge port 112.

As described above, the hair powder stacked in the internal space of the cartridge 200 is primarily dispersed by the air discharged from the second flow tube 220, and then the hair powder is discharged to the outside while secondarily flowing upward by the air supplied from the first flow tube 210, and as a result, the hair powder is easily and uniformly discharged.

Meanwhile, in some cases, the user tilts the cartridge 200 to change the cartridge 200 or as necessary, and when the cartridge 200 is tilted, the hair powder in the cartridge may be unintentionally discharged through the discharge guide 300. To prevent the unintentional discharge of the hair powder, the automatic hair powder dispenser according to the present disclosure may have a ball 320 which is mounted in the discharge guide 300 to block the discharge guide 300 and prevent the hair powder from being discharged when the cartridge 200 is tilted to the extent that the hair powder is discharged.

Hereinafter, a principle in which the discharge of the hair powder is prevented by the ball 320 mounted in the discharge guide 300 will be described with reference to FIGS. 4 to 7. FIG. 4 is an exploded perspective view of a cartridge of the automatic hair powder dispenser according to the present disclosure, FIG. 5 is a cross-sectional view of the cartridge of the automatic hair powder dispenser according to the present disclosure, FIG. 6 is a cross-sectional view taken along line A-A' in FIG. 5, and FIG. 7 is a view illustrating a state in which the cartridge in FIG. 5 is inclined.

Figure 4:
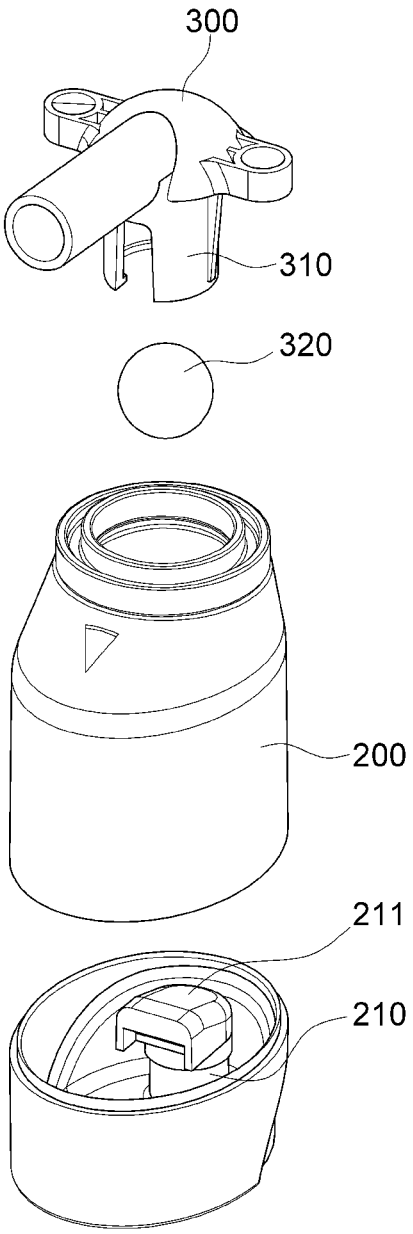
FIG. 4 is an exploded perspective view of a cartridge of the automatic hair powder dispenser according to the present disclosure.

Referring to FIG. 4, a mount 310 for accommodating the ball 320 is formed at a lower side of the discharge guide 300 positioned at the upper side of the cartridge 200. The ball 320 accommodated in the mount 310 is movable in the mount 310 in an up and down direction of the cartridge, the ball 320 is supported by a lower portion of the mount when the ball 320 is positioned at a lowermost side, and the ball 320 blocks the discharge guide 300 to prevent a flow of the hair powder when the ball 320 is positioned at an uppermost side.

Figure 5:
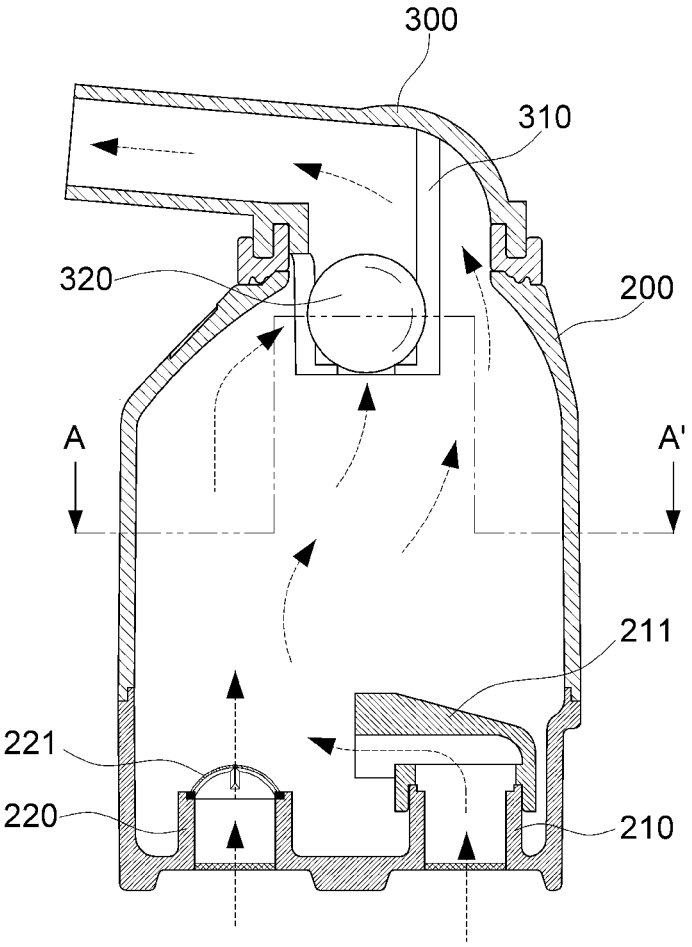
FIG. 5 is a cross-sectional view of the cartridge of the automatic hair powder dispenser according to the present disclosure.
Figure 6:
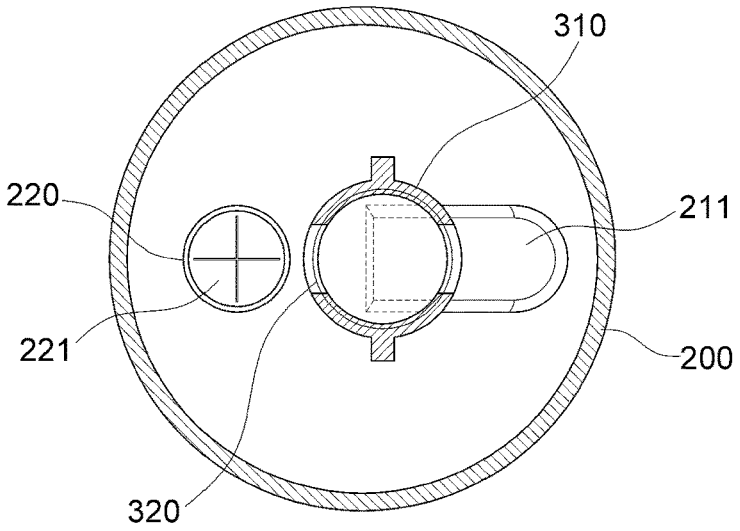
FIG. 6 is a cross-sectional view taken along line A-A' in FIG. 5.

Referring to FIGS. 5 and 6, when the hair powder is discharged in a state in which the cartridge is not tilted or slightly tilted, the discharge of the hair powder is not hindered because the ball 320 is positioned at the lower side of the mount 310. FIG. 6 is a view illustrating a cross section taken along line A-A' in FIG. 5, which illustrates a state in which the ball 320 is accommodated in the mount 310 when viewed from the top side. In the state in which the cartridge 200 is not tilted, the ball 320 is positioned at the lower side of the mount 310, and the hair powder may be discharged to the outside through a space outside the mount 310.

Figure 7:
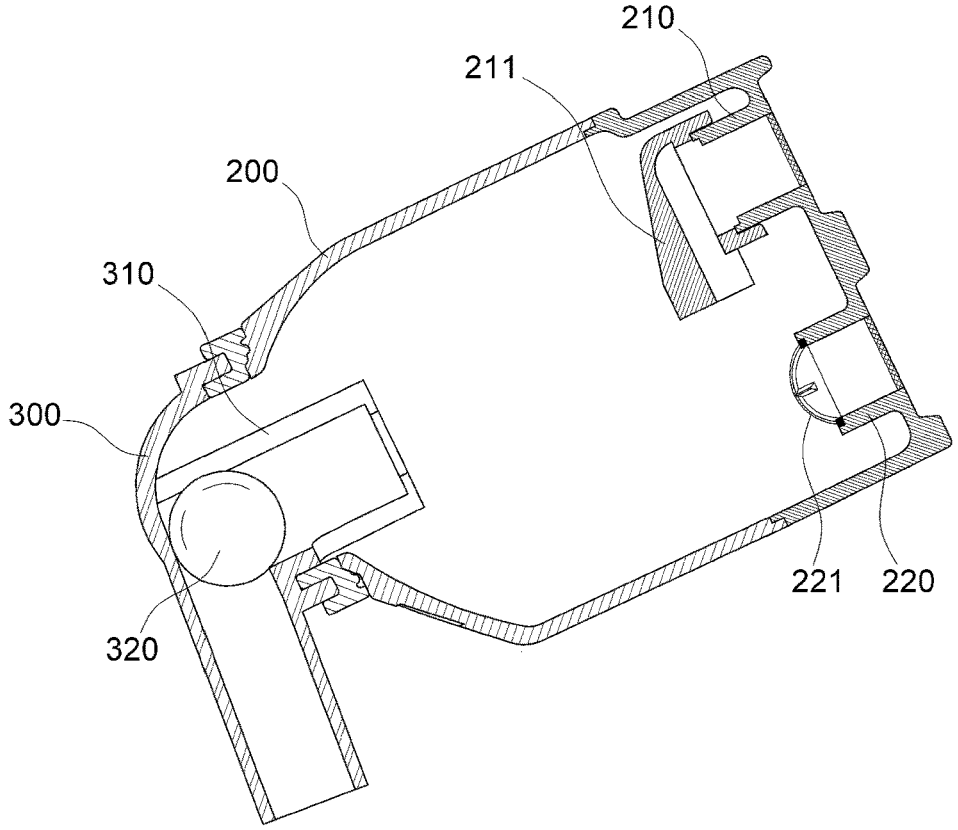
FIG. 7 is a view illustrating a state in which the cartridge in FIG. 5 is inclined.

However, if the cartridge is greatly tilted as necessary, the ball 320 is moved to the upper side of the discharge guide 300 to block the discharge guide 300 as illustrated in FIG. 7, such that the hair powder cannot be discharged.

As described above, the automatic hair powder dispenser according to the present disclosure may efficiently disperse the hair powder in the cartridge and easily and uniformly discharge the hair powder, and the automatic hair powder dispenser may efficiently prevent the hair powder from being unnecessarily discharged when the user does not want to discharge the hair powder.

A list of reference numbers for the drawing figures is below.

100: Housing
110: Front cover
111: Inlet
112: Discharge port
120: Main body
121: Operating button
130: Opening and closing cover
200: Cartridge
210: First flow tube
211: Bent portion
220: Second flow tube
221: Check valve
300: Discharge guide
310: Mount
320: Ball
400: Blower fan unit
410: Motor
420: Blower fan
421: Upper blower
422: Lower blower
430: First supply tube
440: Second supply tube
500: Battery

The invention claimed is:

1. An automatic hair powder dispenser comprising:
a housing;
a cartridge which is installed in the housing and accommodates hair powder;
a blower fan unit which is installed in the housing so as to be in communication with the cartridge; and
a battery which is installed in the housing and supplies electric power to the blower fan unit,
wherein two or more flow tubes through which air supplied from the blower fan unit flows in different directions are provided in the cartridge,
wherein the two or more flow tubes include a first flow tube which protrudes upward from a bottom surface in the cartridge, and a second flow tube which is formed to be spaced apart from the first flow tube and protrudes upward from the bottom surface in the cartridge such that first ends of each of the first flow tube and the second flow tube below the bottom surface receive the air supplied from the blower fan unit, and second ends of each of the first flow tube and the second flow tube within the cartridge provide the air to the interior of the cartridge, and
wherein a bent portion, which changes an air flow, is formed at an upper side of the first flow tube.

2. The automatic hair powder dispenser of claim 1, wherein a flow direction of air, which is introduced into the first flow tube from the blower fan unit, is changed to be directed toward the second flow tube by the bent portion.

3. The automatic hair powder dispenser of claim 2, wherein the hair powder flows upward by air discharged from the first and second flow tubes, and the hair powder is guided to a discharge guide along an inclined surface at an upper side of the second flow tube.

4. An automatic hair powder dispenser comprising:

a housing;

a cartridge which is installed in the housing and accommodates hair powder;

a blower fan unit which is installed in the housing so as to be in communication with the cartridge; and a battery which is installed in the housing and supplies electric power to the blower fan unit, wherein two or more flow tubes through which air supplied from the blower fan unit flows in different directions are provided in the cartridge, wherein the two or more flow tubes include a first flow tube which protrudes upward from a bottom surface in the cartridge, and a second flow tube which is formed to be spaced apart from the first flow tube, wherein a bent portion, which changes an air flow, is formed at an upper side of the first flow tube, and wherein the blower fan unit includes a blower fan, and two or more supply tubes which are in communication with the blower fan, and the two or more supply tubes are in communication with the cartridge.

5. The automatic hair powder dispenser of claim 4, wherein the two or more supply tubes of the blower fan unit are in communication with the two or more flow tubes, respectively.

6. The automatic hair powder dispenser of claim 5, wherein the two or more supply tubes of the blower fan unit include a first supply tube and a second supply tube which are in communication with the interior of the cartridge.

7. The automatic hair powder dispenser of claim 6, wherein the blower fan includes an upper blower and a lower blower, the upper blower is in communication with the first supply tube, and the lower blower is in communication with the second supply tube.

8. The automatic hair powder dispenser of claim 7, wherein the first supply tube of the blower fan unit is in communication with the first flow tube of the cartridge, and the second supply tube of the blower fan unit is in communication with the second flow tube of the cartridge.

9. The automatic hair powder dispenser of claim 7, wherein the first supply tube of the blower fan unit is in communication with the second flow tube of the cartridge, and the second supply tube of the blower fan unit is in communication with the first flow tube of the cartridge.

10. The automatic hair powder dispenser of claim 1, wherein a discharge guide is installed at an upper side of the cartridge, and wherein a mount for accommodating a ball is formed at a lower side of the discharge guide.

11. The automatic hair powder dispenser of claim 10, wherein the ball is movable in the mount in an up and down direction of the cartridge, the ball is supported by a lower portion of the mount when the ball is positioned at a lowermost side, and the ball blocks the discharge guide to prevent a flow of the hair powder when the ball is positioned at an uppermost side.

12. The automatic hair powder dispenser of claim 1, wherein the housing includes a main body, and a front cover installed at a front side of the main body, and the front cover has an inlet through which outside air is introduced, and a discharge port through which the hair powder in the cartridge is discharged to the outside.

13. The automatic hair powder dispenser of claim 12, wherein a discharge guide is installed at an upper side of the cartridge so as to be in communication with the cartridge, and the discharge guide is in communication with the discharge port.

14. The automatic hair powder dispenser of claim 1, wherein the bent portion changes an air flow introduced into the first flow tube from the blower fan unit such that the air flow direction is directed toward the second flow tube.

15. The automatic hair powder dispenser of claim 14, wherein the bent portion changes the air flow introduced into the first flow tube from the blower fan unit such that the airflow direction is directed towards the second end of the second flow tube, where an air flow introduced into the second flow tube from the blower fan unit exits into the cartridge.

16. The automatic hair powder dispenser of claim 1, further comprising:

a discharge guide extending from an upper side of the cartridge to outside of the cartridge that provides a path for discharge of the hair powder.

17. The automatic hair powder dispenser of claim 1, wherein the blower fan unit includes a blower fan and two or more supply tubes in communication with the two or more supply tubes to pass air from the blower fan unit to the two or more flow tubes.

18. The automatic hair powder dispenser of claim 17, wherein the blower fan unit includes a motor, the blower fan installed on a motor shaft of the motor.

19. The automatic hair powder dispenser of claim 17, wherein the blower fan unit includes an upper blower providing air to the first flow tube and a lower blower providing air to the second flow tube.

20. The automatic hair powder dispenser of claim 17, wherein a first supply tube of the two or more supply tubes is coupled to the first end of the first flow tube, and a second supply tube of the two or more supply tubes is coupled to the first end of the second flow tube.

* * * * *